US005483270A

United States Patent [19]

Watanabe

[11] Patent Number: 5,483,270

[45] Date of Patent: Jan. 9, 1996

[54] SUBSTRATE FOR INK JET HEAD

[75] Inventor: Yasutomo Watanabe, Machida, Japan

[73] Assignee: Canon Kabushiki Kaisha, Tokyo, Japan

[21] Appl. No.: 253,225

[22] Filed: Jun. 2, 1994

Related U.S. Application Data

[63] Continuation of Ser. No. 768,253, filed as PCT/JP91/00249, Feb. 26, 1991, abandoned.

[30] Foreign Application Priority Data

Feb. 26, 1990 [JP] Japan ..... 2-042528
Feb. 26, 1990 [JP] Japan ..... 2-042529

[51] Int. Cl.[6] ..... B41J 2/05

[52] U.S. Cl. ..... 347/56; 347/58; 347/65

[58] Field of Search ..... 347/56, 58, 63, 347/65

[56] References Cited

U.S. PATENT DOCUMENTS 4,956,653 9/1990 Braun ..... 346/140 R
5,057,856 10/1991 Takagi et al. ..... 346/140 R
5,081,474 1/1992 Shibata et al. ..... 346/140 R
5,157,418 10/1992 Tamura ..... 346/140 R
5,204,689 4/1993 Shirato et al. ..... 346/1.1
5,227,812 7/1993 Watanabe et al. ..... 346/140 R

*Primary Examiner*—Peter S. Wong
*Assistant Examiner*—Eric Frahm
*Attorney, Agent, or Firm*—Fitzpatrick, Cella, Harper & Scinto

[57] ABSTRACT

An improved substrate for an ink jet head includes a pair of first wiring electrode layers disposed on a base member through a first electrode contact layer, and a pair of second wiring electrode layers disposed on a pair of first wiring electrode layers through a second electrode contact layer composed of an electroconductive material such that the pair of second wiring electrode layers correspond to the pair of first wiring electrode layers. Either the first electrode contact layer or the second electrode contact layer contains a heat generating resistor layer capable of being energized upon the application of a voltage through the pair of first wiring electrode layers or the pair of second wiring electrode layers.

19 Claims, 10 Drawing Sheets

SUBSTRATE FOR INK JET HEAD

This application is a continuation of application Ser. No. 07/768,253 filed as PCT/JP91/00249, Feb. 26, 1991, now abandoned.

BACKGROUND OF THE INVENTION

1. Field of the Invention

The present invention relates to a substrate for ink jet head for use in an ink jet head for discharging an ink and recording images of characters or the like with the ink discharged. The present invention relates also to an ink jet head in which said substrate for ink jet head is used. The present invention further relates to an ink jet apparatus provided with said ink jet head. The present invention includes a process for producing said substrate for ink jet head.

2. Background of the Invention

As for the ink jet recording system, there have been proposed a variety of systems. Among such proposals, as a typical one, the public attention has been focused on those ink jet systems disclosed, for example, in U.S. Pat. Nos. 4,723,129 and 4,740,796 in recent years. These ink jet systems are of the type that an ink is discharged utilizing thermal energy and recording is performed with the ink discharged. And there are advantages for these ink jet systems that recording of a high quality image with a high density and a high resolution can be performed at a high speed, and it is relatively easy to make a head or an apparatus compact.

By the way, the typical configuration of a so-called substrate (hereinafter occasionally referred to as "head substrate") which constitutes the head used in such ink jet system as above described is, for example, such that is schematically shown in FIG. 3. In FIG. 3. FIG. 3(*a*) is a schematic plan view and FIG. 3(*b*) is a schematic cross-sectional view taken along line D–D' in FIG. 3(*a*).

The head substrate of the configuration shown in FIG. 3 is generally produced through steps shown in FIG. 1 and FIG. 2. In FIG. 1, FIG. 1(*a*) is a schematic plan view and FIG. 1(*b*) is a schematic cross-sectional view of FIG. 1(*a*). In FIG. 2, FIG. 2(*a*) is a schematic plan view and FIG. 2(*b*) is a schematic cross-sectional view taken along line D–D' in FIG. 2(*a*).

Explanation is to be made about the steps of producing the head substrate with reference to FIGS. 1 through 3.

As shown in FIG. 1(*a*) and FIG. 1(*b*), a material layer (two-layered layer) for forming a first electrode contact layer 2 comprising a heat-generating resistor layer composed of, for example, $HfB_2$ and a layer composed of, for example, Ti being stacked in this order from the side of an insulating base member 1 and a material layer for forming a wiring electrode 3 composed of, for example, a good conductive material such as Al are formed on the insulating base member 1 by a thin film-forming technique such as an evaporation method, a sputtering method and a CVD method. Then, as shown in FIG. 2(*a*) and FIG. 2(*b*), the previously formed material layer for the electrode contact layer 2 and the previously formed material layer for the wiring electrode layer 3 are subjected to patterning by photolithography. Successively, as shown in FIG. 3(*a*) and FIG. 3(*b*), the patterned material layer for the wiring electrode layer 3 is subjected to further patterning to expose part of the electrode contact layer 2, thereby forming a heat generating portion 10. It is possible for the heat generating portion 10 thus formed to be used such that it is in contact with ink as it is, depending upon the kind of a material to constitute it. However, in general, in order to protect the heat generating portion from corrosion and the like by ink, a protective layer is formed thereon.

The head substrate is produced through these production steps. And an ink jet apparatus provided with an ink jet head having a plurality of discharge outlets capable of discharging ink in which the above head substrate being used has been commercialized.

However, for the ink jet apparatus, there is a demand for further improving not only its recording speed but also the quality of an image recorded. As an ideal ink jet head which can satisfy this demand, there can be mentioned such an ink jet head that is basically provided with numerous ink discharging outlets as many as possible such that they are arranged with a high density.

In order to realize such ideal ink jet head, such matters as will be mentioned in the following, which have been disregarded until now, will be spotlighted as the problems to be solved. That is, with respect to the head substrate, defects such as pinholes or missing portions occasionally occur at photoresist layer to be used, for example, at the time of performing patterning of wiring electrode and those defects occurred extend to the wiring electrode layer to be patterned, or film defects such as pinholes or the like occasionally occur at an electrothermal converting body during the film formation. These things eventually greatly influence on the yield in the case of producing a head substrate provided with numerous ink discharging outlets being arranged at a high density.

As a typical example of the situation as above described, there can be illustrated such a disconnection of tile wiring electrode as indicated by the mark C in FIG. 2 and FIG. 3.

In the case of a head substrate provided with a relatively small number of ink discharging outlets being arranged at a relatively low density, the above point can be more or less admitted even if the yield is relatively low. But it becomes a problem which cannot be disregarded in the case of a head substrate provided with numerous ink discharging outlets being arranged at a high density. Particularly, it is a serious technical subject. In the case of a so-called full-line type ink jet head which is provided with numerous ink discharging outlets being arranged at a high density along the entire width of the recording area of a member on which an image is to be recorded in which numerous electrothermal converting bodies are arranged at high density on a base member such that they correspond to said numerous ink discharging outlets.

SUMMARY OF THE INVENTION

A principal object of the present invention is to overcome the foregoing technical subject by contriving a specific design to the structure of the wiring electrode portion of the ink jet head of the type that ink is discharged utilizing thermal energy and to provide an ink jet head with a markedly improved head reliability.

Another object of the present invention is to provide an ink jet head wherein the foregoing technical subject relating to reduction in the yield due to the discontinuation caused because of the defects occurred at the electrothermal converting body is solved without a negative influence of thermal energy to the strength of the head by contriving a specific design to the structure of the electrothermal converting body having a heat generating resistor layer serving to generate thermal energy to be utilized for discharging ink and an electrode being connected to the heat generating resistor layer.

A further object of the present invention is to provide an ink jet head with numerous electrothermal converting bodies, serving to generate thermal energy to be utilized for discharging ink, being arranged at a high density on a base member wherein the foregoing technical subject, which is liable in such ink jet head, can be solved by a relatively simple structural contrivance.

A further object of the present invention is to provide a full-line type ink jet head provided with numerous ink discharging outlets being arranged at a high density in which numerous electrothermal converting bodies are arranged at a high density on a substrate such that they correspond to said numerous ink discharging outlets wherein the foregoing technical subject, which is liable in such ink jet head, can be solved by a relatively simple structural contrivance.

A further object of the present invention is to provide a substrate for use in the above ink jet head, an ink jet apparatus provided with the above head and a process for producing a substrate for ink jet head.

As a result of intensive studies in order to attain the above objects, the present inventor has obtained a knowledge based on the constitution which will be described in the following. That is, in a process of producing the known head substrate, a pair of first wiring electrode layers are disposed on a base member through a first electrode contact layer. In this case, the present inventor has established a stacked structure comprising multilayers being stacked by disposing further a pair of second wiring electrode layers through a second electrode contact layer thereon, and have made studies about the resulting structure.

As a result, the following facts have been found. That is, in the case of taking such constitution as above mentioned, even if a defect such as a missing portion or discontinuation is present in one pair of wiring electrode layers, said defect is covered by the other pair of wiring electrode layers, and because of this, a negative influence due to said defect on the whole can be made to be substantially zero; and this leads to significantly improving the yield in the production of an ink jet head.

The present inventor then has applied the above finding in the production of a head substrate. And as for the resultant head substrate, the situation of occurrence of a discontinuation has been examined. As a result, it has been found that the probability of a discontinuation occurring is markedly decreased. Then, an ink jet head has been prepared using the resultant head substrate, and the resultant ink jet head has been set to an apparatus main body to perform image recording by discharging ink. As a result, it has been found that the instant ink jet head is one capable of attaining the above objects of the present invention.

The substrate for ink jet head of the present invention which has been thus accomplished is characterized in that said substrate for ink jet head has a pair of first wiring electrode layers being disposed on a base member through a first electrode contact layer and a pair of second wiring electrode layers being disposed on said pair of first wiring electrode layers through a second electrode contact layer such that said pair of second wiring electrode layers correspond to said pair of first wiring electrode layers, wherein said first electrode contact layer contains a heat generating resistor layer capable of generating heat upon applying a voltage through said pair of first wiring electrode layers and said pair of second wiring electrode layers.

Further, the substrate for ink jet head of the present invention is characterized in that it has a pair of first wiring electrode layers being disposed on a base member through a first electrode contact layer and a pair of second wiring electrode layers being disposed on said pair of first wiring electrode layers through a second electrode contact layer such that said pair of second wiring electrode layers correspond to said pair of first wiring electrode layers, wherein said second electrode contact layer contains a heat generating resistor layer capable of generating heat upon applying a voltage through said pair of first wiring electrode layers and said pair of second wiring electrode layers.

Further in addition, the present invention includes an ink jet head including the above mentioned substrate for ink jet head, an ink jet apparatus provided with said head and a process for producing a substrate for ink jet head.

DETAILED DESCRIPTION OF THE PREFERRED EMBODIMENTS

An embodiment of the present invention will be explained with reference to the drawings.

Figure 1A:
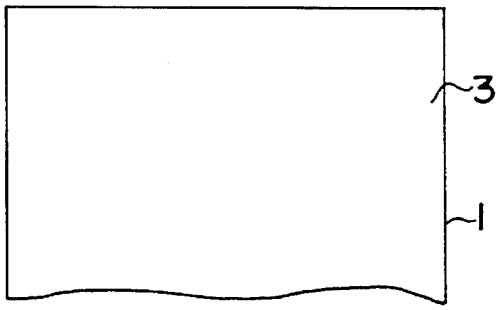
FIG.1(a) PRIOR ART
FIGS. 1–3 are schematic explanatory views of the steps of producing a conventional substrate for ink jet head, wherein FIG. 1(*a*) is a schematic plan view of a first work in process, FIG. 1(*b*) is a schematic cross-sectional view of the work in process shown in FIG. 1(*a*), FIG. 2(*a*) is a schematic plan view of a second work in process obtained from the work in process of FIGS. 1(*a*) and 1(*b*), FIG. 2(*b*) is a schematic cross-sectional view, taken along the line D–D' in FIG. 2(*a*), FIG. 3(*a*) is a schematic plan view of a final product from the second work in process shown in FIGS, 2(*a*) and 2(*b*), and FIG. 3(*b*) is a schematic cross-sectional view, taken along the line D–D' in FIG. 3(*a*)
Figure 1B:
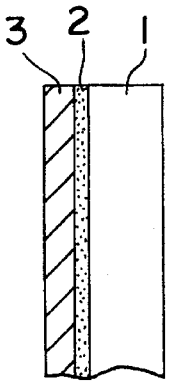
FIG.1(b) PRIOR ART
Figure 2A:
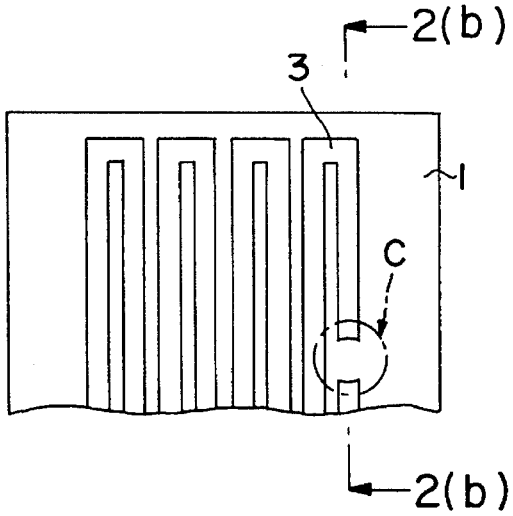
FIG.2(a) PRIOR ART
Figure 2B:
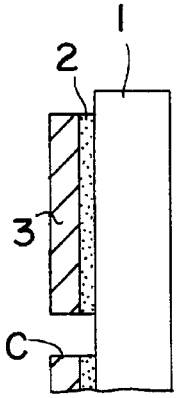
FIG.2(b) PRIOR ART
Figure 3A:
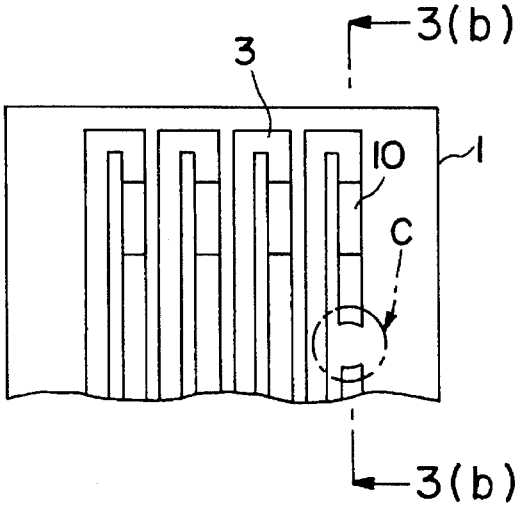
FIG.3(a) PRIOR ART
Figure 3B:
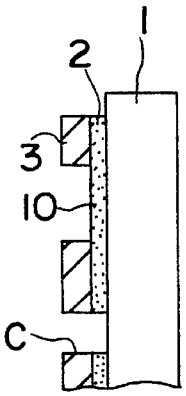
FIG.3(b) PRIOR ART
Figure 4A:
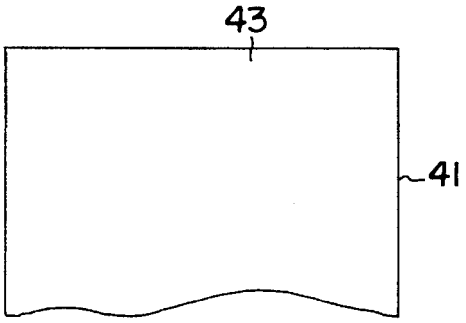
FIGS. 4–8 are schematic explanatory views of the steps of producing an example of a substrate for ink jet head according to the present invention, wherein FIG. 4(*a*) is a schematic plan view of a first work in process, FIG. 4(*b*) is a schematic cross-sectional view, taken along a given vertical line in FIG. 4(*a*), FIG. 5(*a*) is a schematic plan view of a second work in process obtained from the first work in process shown in FIGS. 4(*a*) and 4(*b*), FIG. 5(*b*) is a schematic cross-sectional view, taken along the line B–B' in FIG. 5(*a*), FIG. 5(*c*) is a schematic cross-sectional view, taken along the line A–A' in FIG. 5(*a*), FIG. 6(*a*) is a schematic plan view of a third work in process obtained from the second work in process shown in FIGS. 5(*a*)–5(*c*), FIG. 6(*b*) is a schematic cross-sectional view, taken along a given line at the left side in FIG. 6(*a*), FIG. 6(*c*) is a schematic cross-sectional view, taken along a given line at the right side in FIG. 6(*a*), FIG. 7(*a*) is a schematic plan view of a fourth work in process obtained from the third work in process shown in FIGS. 6(*a*)–6(*c*), FIG. 7(*b*) is a schematic cross-sectional view, taken along a given line containing the portion B" at the left side in FIG. 7(*a*), FIG. 7(*c*) is a schematic cross-sectional view, taken along a given line containing the portion 51 at the right side in FIG. 7(*a*), FIG. 8(*a*) is a schematic plan view of a final product obtained from the fourth work in process shown in FIGS. 7(*a*)–7(*c*), FIG. 8(*b*) is a schematic cross-sectional view, taken along a given line containing the portion B" at the left side in FIG. 8(*a*), and FIG. 8(*c*) is a schematic cross-sectional view, taken along a given line containing the portion 50 at the right side in FIG. 8(*a*)
Figure 4B:
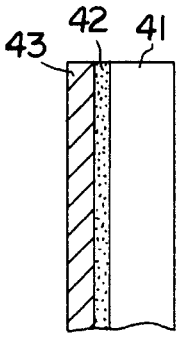
Figure 5A:
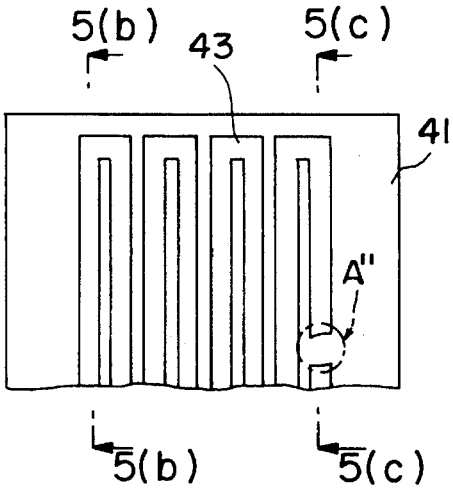
Figure 5B:
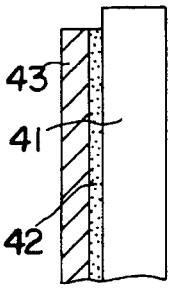
Figure 5C:
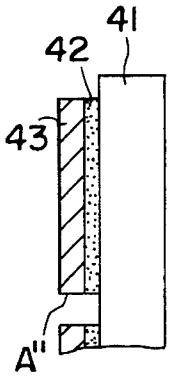

FIGS. 4 through 8 are schematic views illustrating an example of the substrate for ink jet head according to the present invention in accordance with the successive production steps. In FIG. 5, FIG. 5(*a*) is a plan view, FIG. 5(*b*) is a cross section view taken along line B–B' in FIG. 5(*a*), and FIG. 5(*c*) is a cross section view taken along line A–A' in FIG. 5(*a*). In other figures than FIG. 5 among these figures, the indication A–A' and the indication B–B' are omitted, but any of them is a drawing of the same portion as in FIG. 5 which is observed from the same direction as in the case of FIG. 5.

Firstly, as shown in FIG. 4(*a*) and FIG. 4(*b*), there are formed a material layer as a first electrode contact layer 42 comprising a heat generating resistor layer composed of $HfB_2$, TaAl, TaSi, CrSiO, $TiO_2$, etc. and a layer composed of Ti, Cr, Ni, Mo, W, etc. being stacked in this order on an insulating base member 41 comprising alumina having a glaze layer on a surface thereof, silicon having a thermally oxidized $SiO_2$ layer on a surface thereof, glass or the like, and a material layer as a first wiring electrode layer 43 composed of Al, Cu, Au, or the like. In the figure (for example, FIG. 4), for simplification purpose, the same numeral references as those employed in the case after patterning are employed also for the layer as the material layer which is disposed in a solid-like state on the whole surface.

Then, as shown in FIG. 5(*a*) through FIG. 5(*c*), a photoresist is applied (not shown in the figure), followed by exposure, development, baking, and the like. Successively, etching and removal of the resist are performed to pattern the material layer for first electrode contact layer 42 and the material layer for first wiring electrode layer 43, thereby forming a pattern of the first electrode contact layer 42 and a pattern of the wiring electrode layer 43. In this example, there is found such a discontinuation as indicated by A", caused by a defect or the like of the photoresist, which is present between the first electrode contact layer 42 and the wiring electrode layer 43.

Figure 6A:
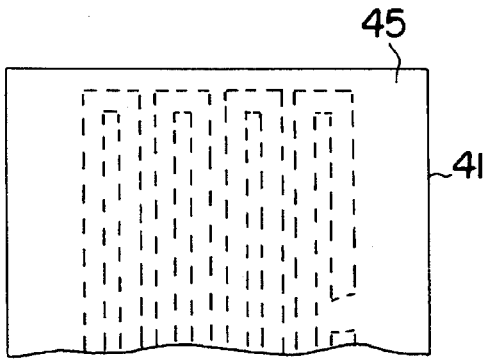
Figure 6B:
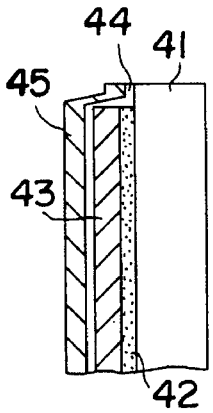
Figure 6C:
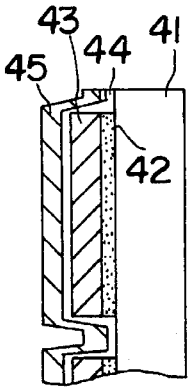

Successively, as shown in FIG. 6(*a*) through FIG. 6(*c*), there are formed a material layer for second electrode contact layer 44 composed of Ti, Cr, Ni, Mo, W, etc. and a material layer for second wiring electrode layer 45 composed of Al, Cu, Au, etc. In this case, the second electrode contact layer 44 has an etching selectivity against the second wiring electrode layer 45. Particularly, the second electrode contact layer 44 is formed of a material which is not etched by an etching solution with which the second wiring electrode layer 45 is etched. Herein, an exposed portion at the defective portion A" is covered by the material layer of the second electrode contact layer 44 and the material layer for second wiring electrode layer 45.

Figure 7A:
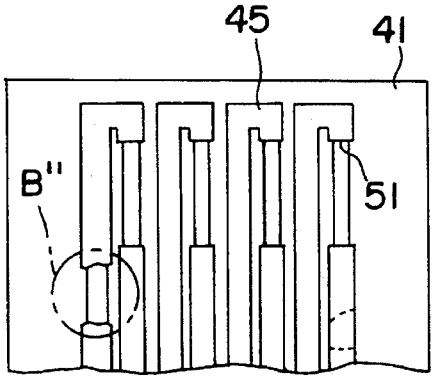
Figure 7B:
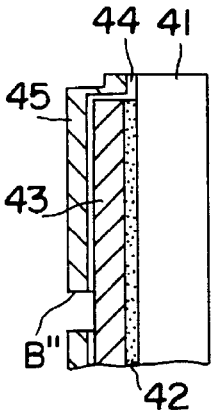
Figure 7C:
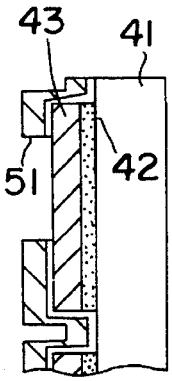

Thereafter, as shown in FIG. 7(*a*) through FIG. 7(*c*), there is formed a second wiring electrode layer 45 by a photolithography method in the same manner as described in the above. This second wiring electrode layer 45 is formed through patterning with the use of a photoresist, etching of the material layer of the second wiring electrode layer 45, etching of the material layer of the second electrode contact layer 44, and removal of the photoresist. At this time, as shown in the figure, part of each of the second electrode contact layer 44 and the second wiring electrode 45 is removed by means of etching to form a portion 51 for forming the heat generating portion in advance.

Herein, even if a defect of the second wiring electrode layer 45 should occur, for instance, at the portion B" shown in the figure, due to a defect or the like of the photoresist, such defect is not extended to the lower layers (the first wiring electrode layer 43 and the first electrode contact layer 42), and because of this, the circuit is never discontinued.

Figure 8A:
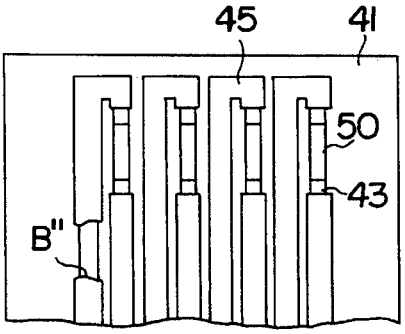
Figure 8B:
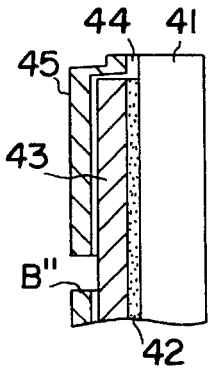
Figure 8C:
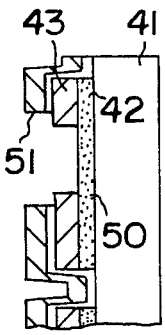

Then, as shown in FIG. 8(*a*) through FIG. 8(*c*), the second wiring electrode layer 43 situated in the portion 51 for forming the heat generating portion is etched by a photolithography method in the same manner as described in the above to thereby expose the first electrode contact layer 42 thereunder, whereby a heat generating portion 50 is formed. In this case, as above described, since the second electrode contact layer 44 is not etched by the etching solution for the second wiring electrode layer 45, even if a defect should occur at the second wiring electrode layer 45 due to a defect or the like of the photoresist, such defect is not extended to the lower layers (the first wiring electrode layer 43 and the first electrode contact layer 42).

On the multilayered structure comprising the thin films being stacked which is formed on the base member in the way as above described, a $SiO_2$ layer as the protective layer is formed by a sputtering method. Thus, there is obtained a substrate for ink jet head.

Specific examples for the combination of the materials to constitute the multilayered structure comprising the first wiring electrode layer/the second electrode contact layer/the second wiring electrode layer can include combination of Al layer/Ti layer/Al layer, combination of Al layer/Cr layer/Al layer, combination of Cu layer/Ti layer/Cu layer, combination of Au layer/Ni layer/Au layer, combination of Al layer/TaSi layer/Cu layer, etc. Among these combinations, the combination of Al layer/Ti layer/Al layer is the most desirable.

In the following, explanation is to be made about other embodiment of the present invention with reference to the drawings.

FIG. 9 through FIG. 13 are schematic views illustrating other example of the substrate for ink jet head according to the present invention in accordance with production steps.

Figure 10A:
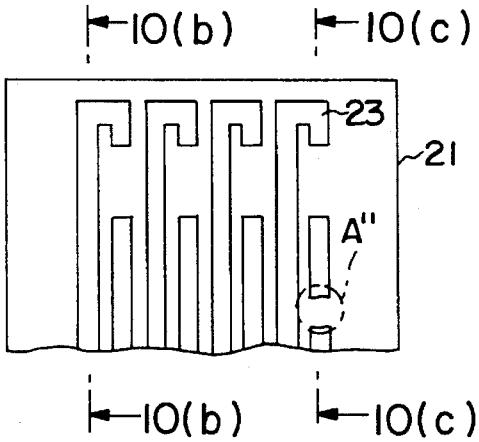
Figure 10B:
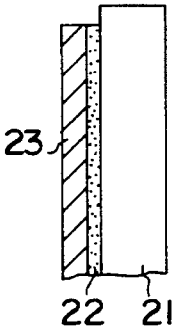
Figure 10C:
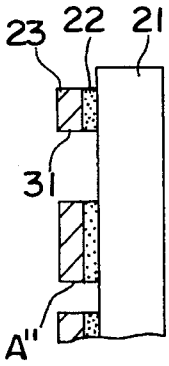

In the drawings of FIG. 10, FIG. 10(*a*) is a plan view, FIG. 10(*b*) is a cross section view taken along line B–B' in FIG. 10(*a*), and FIG. 10(*c*) is a cross section view taken along line A–A' in FIG. 10(*a*).

Among these figures, in other figures than the figures of FIG. 10, the indication of A–A' and the indication of B–B' are omitted, but any of them is a drawing of the same portion as in FIG. 10 which is observed from the same direction as in the case of FIG. 10.

Figure 9A:
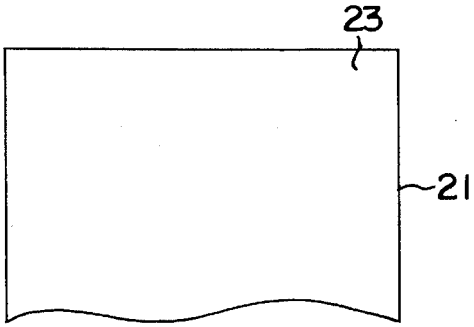
FIGS. 9–13 are schematic explanatory views of the steps of producing another example of a substrate for ink jet head according to the present invention, wherein FIG. 9(*a*) is a schematic plan view of a first work in process, FIG. 9(*b*) is a schematic cross-sectional view, taken along a given vertical line in FIG. 9(*a*), FIG. 10(*a*) is a schematic plan view of a second work in process obtained from the first work in process shown in FIGS. 9(*a*) and 9(*b*), FIG. 10(*b*) is a schematic cross-sectional view, taken along the line B–B' in FIG. 10(*a*), FIG. 10(*c*) is a schematic cross-sectional view, taken along the line A–A' in FIG. 10(*a*), FIG. 11(*a*) is a schematic plan view of a third work in process obtained from the second work in process shown in FIGS. 10(*a*)–10(*c*), FIG. 11(*b*) is a schematic cross-sectional view, taken along a given line at the left side in FIG. 11(*a*), FIG. 11(*c*) is a schematic cross-sectional view, taken along a given line at the right side in FIG. 11(*a*), FIG. 12(*a*) is a schematic plan view of a fourth work in process obtained from the third work in process shown in FIGS. 11(*a*)–11(*c*), FIG. 12(*b*) is a schematic cross-sectional view, taken along a given line containing the portion B" at the left side in FIG. 12(*a*), FIG. 12(*c*) is a schematic cross-sectional view, taken along a given line at the right side in FIG. 12(*a*), FIG. 13(*a*) is a schematic plan view of a final product obtained from the fourth work in process shown in FIGS. 12(*a*)–12(*c*), FIG. 13(*b*) is a schematic cross-sectional view, taken along a given line containing the portion B" at the left side in FIG. 13(*a*), and FIG. 13(*c*) is a schematic cross-sectional view, taken along a given line containing the portion 30 at the right side in FIG. 13(*a*)
Figure 9B:
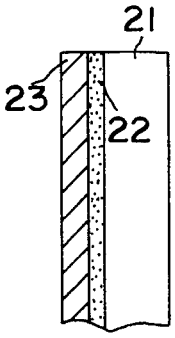

Firstly, as shown in FIG. 9(*a*) and FIG. 9(*b*), on an insulating base member 21 composed of, for example, the same kind of material as that in the foregoing embodiment, there are formed a material layer for first electrode contact layer 22, composed of Ti, Cr, Ni, Mo, W, etc., and a material layer for first wiring electrode layer 23, composed of Al, Cu, Au, etc. In the figure (for instance, FIG. 9), for simplification purpose, the same numeral references as those employed in the case after patterning are employed also for the layer as the material layer which is disposed in a solid-like state on the whole area.

Then, as shown in FIG. 10(*a*) through 10(*c*), a photoresist is applied (not shown in the figure), followed by exposure, development, baking, and the like.

Successively, etching and removal of the photoresist are performed to pattern the material layer for first electrode contact layer 22 and the material layer for fist wiring electrode layer 23. Herein, a discontinued portion for forming a heat generating portion 31 is formed at part of each of the first electrode contact layer 22 and the first wiring electrode layer 23. In this example, there is found such a discontinuation as indicated by A", caused by a defect or the like of the photoresist, which is present between the first electrode contact layer 22 and the first wiring electrode layer 23.

Figure 11A:
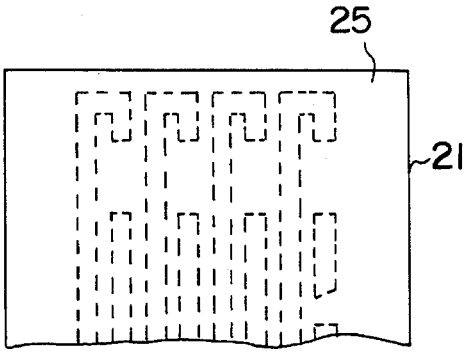
Figure 11B:
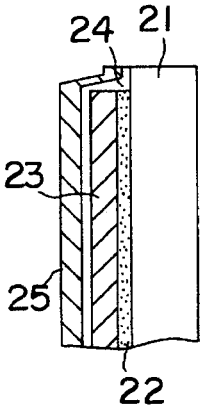
Figure 11C:
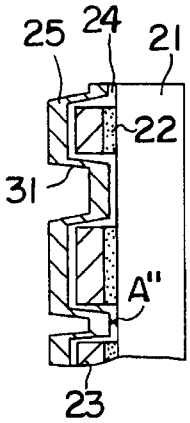

Thereafter, as shown in FIG. 11(*a*) through FIG. 11(*c*), there are formed a material layer for second electrode contact layer 24 comprising a heat generating resistor layer composed of $HfB_2$, TaAl, TaSi, CrSiO, $TiO_2$, etc. and a layer composed of Ti, Cr, Ni, Mo, W, etc. being stacked in this order, and a material layer for second wiring electrode layer 25, composed of Al, Cu, Au, etc. In this case, the second electrode contact layer 24 has an etching selectivity against the second wiring electrode layer 25. Particularly, the second electrode contact layer 24 is formed of a material which is not etched by an etching solution with which the second wiring electrode layer 25 is etched. Herein, an exposed portion at the defective portion A" is covered by the material layer for second electrode contact Layer 24 and the material layer for second wiring electrode layer 25.

Figure 12A:
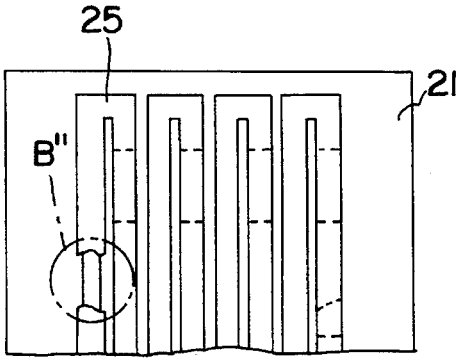
Figure 12B:
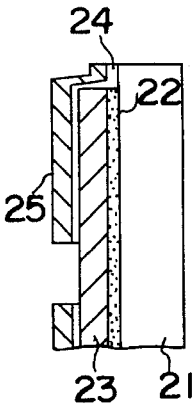
Figure 12C:
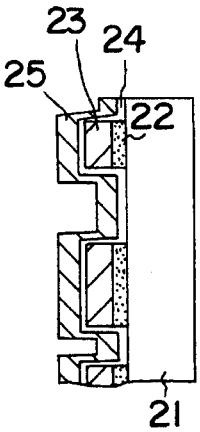

Subsequently, as shown in FIG. 12(*a*) through FIG. 12(*c*), there is formed a second wiring electrode layer 25 by a photolithography method in the same manner as described in the above. This second wiring electrode layer 25 is formed through patterning with the use of a photoresist, etching of the material layer for second wiring electrode layer 25, etching of the material layer for second electrode contact layer 24, and removal of the photoresist.

Herein, even if a defect of the second wiring electrode layer 25 should occur, for instance, at the portion B" shown in the figure, due to a defect or the like of the photoresist, such defect is not extended to the lower layers (the first wiring electrode layer 23 and the first electrode contact layer 22), and because of this, the circuit is never discontinued.

Figure 13A:
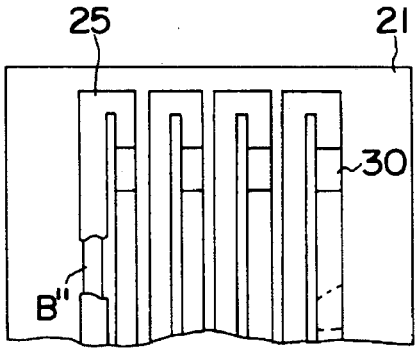
Figure 13B:
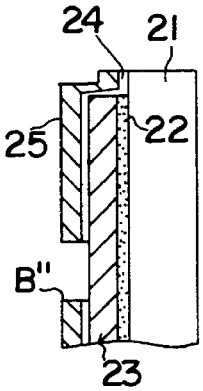
Figure 13C:
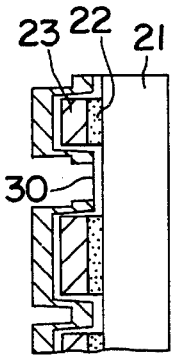

Then, as shown in FIG. 13(*a*) through FIG. 13(*c*), part of the second wiring electrode layer 25 (portion 31 for forming a heat generating portion) is etched by a photolithography method in the same manner as described in the above to thereby expose part of the second electrode contact layer 24, whereby a heat generating portion 30 is formed. In this case, as above described, since the second electrode contact layer 24 is not etched by the etching solution for the second wiring electrode layer 25, the heat generating portion 30 is exposed without causing a defect at the second electrode contact layer 24. In this step, even if a defect should occur at the second wiring electrode layer 25 due to a defect or the like of the photoresist, such defect is not extended to the lower layers (the first wiring electrode layer 23 and the first electrode contact layer 22).

On the multilayered structure comprising the thin films being stacked which is formed on the base member in the way as above described, a $SiO_2$ layer as the protective layer is formed by a sputtering method. Thus, there is obtained a substrate for ink jet head.

Specific examples for the combination of the materials to constitute the multilayered structure comprising the first wiring electrode layer/the second electrode contact layer/the second wring electrode layer can include combination of Al layer/Ti layer+ insulating material layer/Al layer, combination of Al layer/Cr layer+insulating material layer/Al layer, combination of Cu layer/Ti layer+insulating material layer/Cu layer, combination of Au layer/Ni layer+ insulating material layer/Au layer, combination of Al layer/TaSi layer/Cu layer, etc. Among these combinations, the combination of Al layer/Ti layer+ insulating layer/Al layer is the most desirable.

In this embodiment, since the step of performing etching by way of sputtering is carried out prior to forming the material layer for the heat generating insulator layer, the surface on which a film is to be formed is smoothed and cleaned, and because of this, an improvement is provided in the adhesive property of the heat generating insulator layer.

As explained in the above embodiments, in order to prevent occurrence of discontinuation at the wiring electrode due to a defect of the photoresist or defects caused upon film formation, there is selectively used, as the constituent material of the second electrode contact layer 44, a material having an etching selectivity against the second wiring electrode layer, specifically, such a material that is not etched by an etching material with which the second wiring electrode layer 45 is etched.

For instance, in the case of using Al as the constituent material of each of the first wiring electrode layer 42 and the second wiring electrode layer 45, and Ti as the constituent material of the second electrode contact layer 44, using a mixed solution of acetic acid, phosphoric and nitric acid as the etching solution for the constituent material Al of the second wiring electrode layer 45, and performing reactive plasma etching against the constituent material Ti of the second electrode contact layer 44 with the use of $CF_4$, the constituent material Al of the wiring electrode layer 45 is etched by the above etching mixed solution, whereas the constituent material Ti of the second electrode contact layer 45 is not etched by said etching mixed solution. And when reactive plasma etching with the use of $CF_4$ is performed against the constituent material Ti of the second electrode contact layer 44 using an identical photoresist, the second electrode contact layer 44 is etched, whereas the constituent material Al of the first wiring electrode layer 43 is not etched. In this case, the fist wiring electrode 43 is not etched, for example, even at the defective portion B". Thus, discontinuation never occurs at the wiring electrode.

Now, when a defect is present at the photoresist for forming the first wiring electrode layer, the wiring electrode becomes discontinued as a result that etching is caused, for example, in such a state as indicated by the A" portion shown in FIG. 5 upon forming the first wiring electrode layer. However, the second wiring electrode layer 45 is formed thereon to cover such defective portion in a state that discontinuation does not occur at the portion A".

In addition, in the above-mentioned step of producing a substrate for ink jet head, the probability that the defective portion A" and the defective portion B" will occur at the same position is extremely small to such an extent that can be said to be substantially zero in comparison with that in the case where each of the defective portion A" and the defective portion B" will independently occur, and because of this, there is not such occasion that a defect occurs at the respective layers throughout production. As a result, the wiring electrode is made to be substantially free of discontinuation, and in addition to this, the yield in the production steps is markedly improved and the production cost is markedly reduced.

Figure 14:
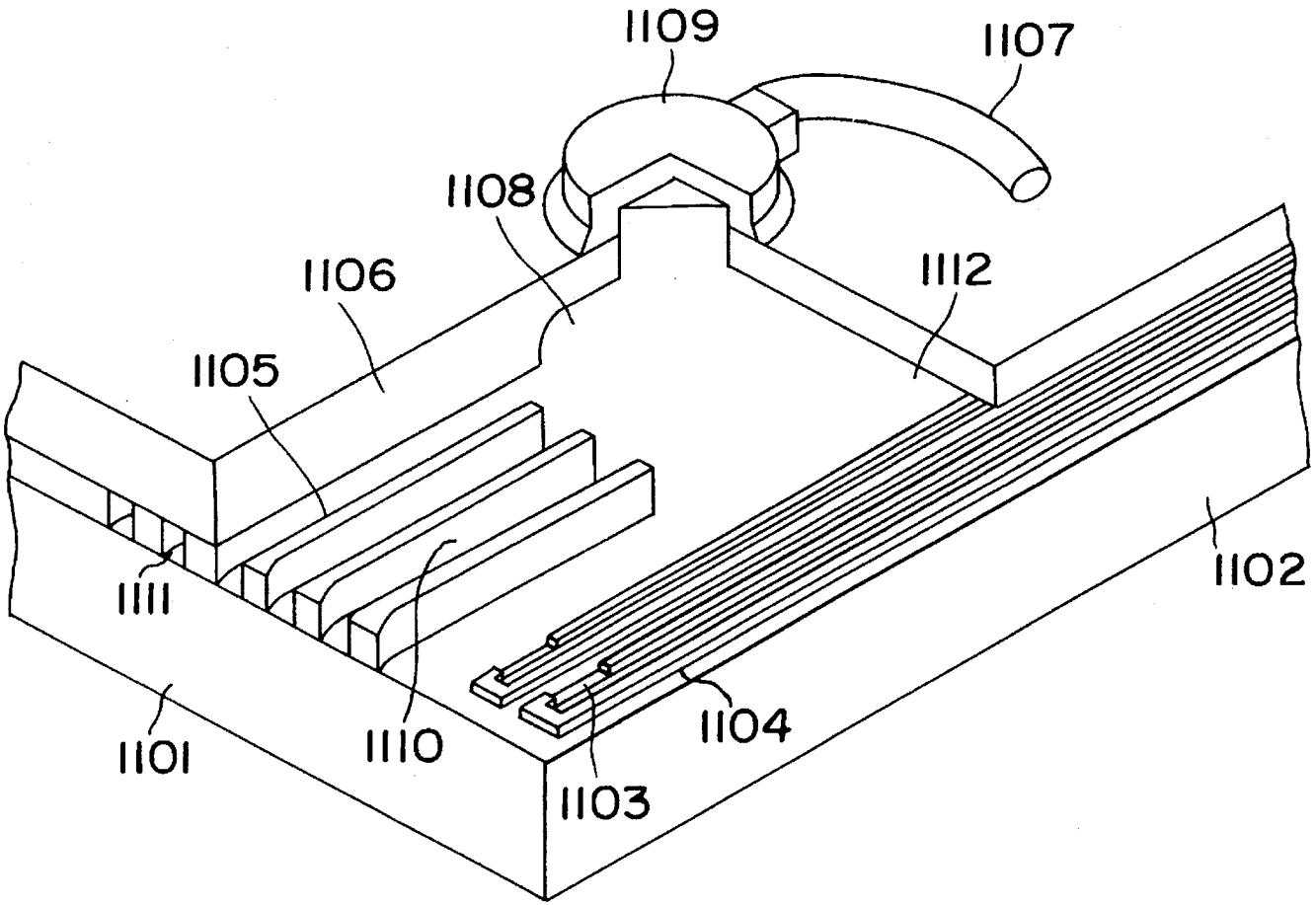
FIG. 14 is a schematic view illustrating an ink jet head.

FIG. 14 is a schematic slant view illustrating an embodiment of an ink jet head, prepared using the substrate for ink jet head obtained in the above description.

In the figure, on a base member 1102 are disposed heat generating portions 1103 of electrothermal converting body containing electrode 1104 (protective layer is not shown in the figure), on which ink pathway walls 1105 and a top plate 1106 are disposed. Ink 1112 is supplied from an ink reservoir (not shown in the figure) through an ink supply pipe 1107 into a common ink chamber 1108 of ink jet head 1101. In the figure, numeral reference 1109 stands for a connector for supplying ink. The ink supplied into the common ink chamber 1108 is supplied into ink pathways 1110 due to a so-called capillary action and it is stably maintained by forming meniscus in discharging outlets 1111 in communication with the ink pathways. The ink present on the heat generating portion 1103 of the electrothermal converting body is instantly heated upon heat generation at the heat generating portion 1103 to cause formation of a gas bubble in the ink in the ink pathways, thereby jetting out ink through the discharging outlets 1111. In this figure, there is described an ink jet head provided with numerous discharging outlets of 128 to 256 in number being arranged with a density of 16 discharging outlets per millimeter.

Figure 15:
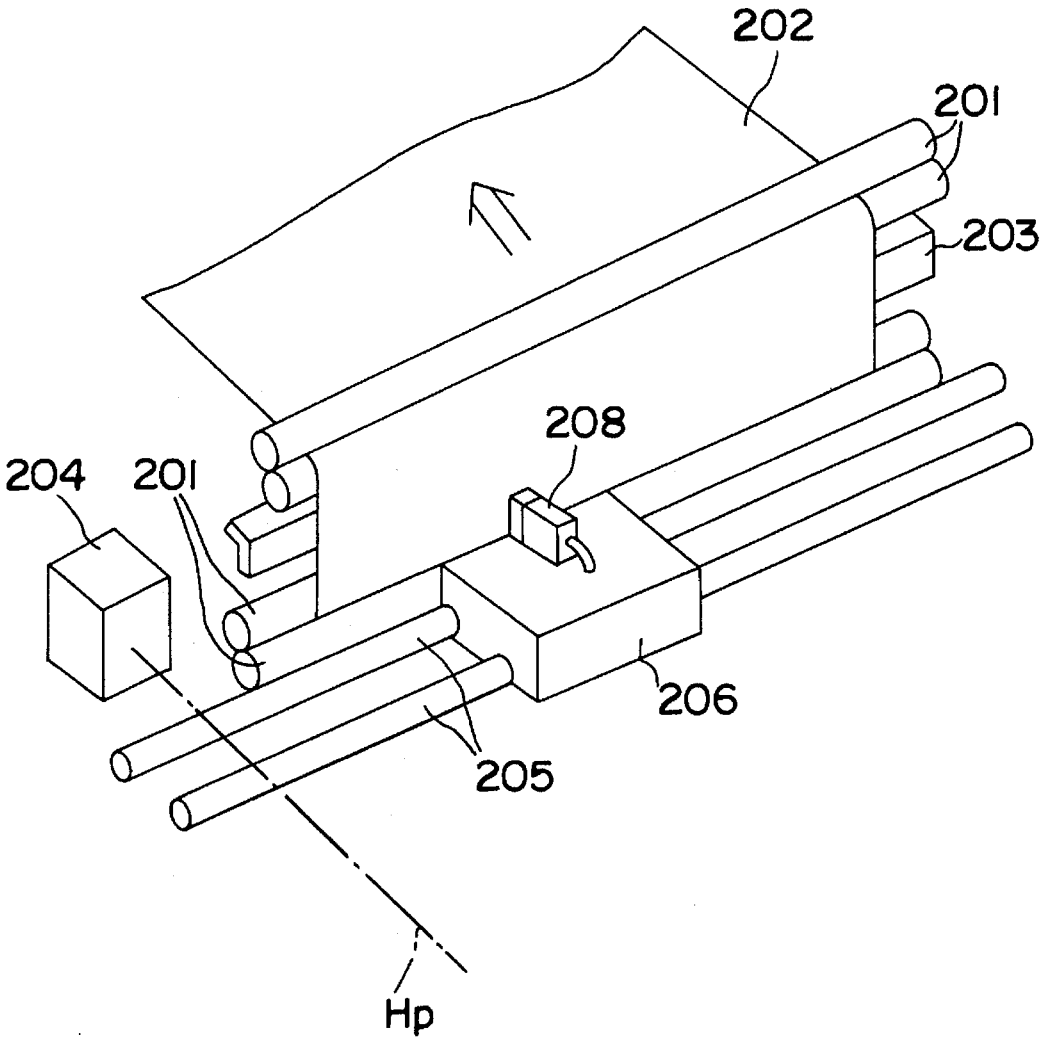
FIG. 15 is a schematic view of an ink jet apparatus in which the ink jet head shown in FIG. 14 is installed.

FIG. 15 is a schematic slant view illustrating the principal portion of an embodiment of an ink jet apparatus in which the ink jet head shown in FIG. 14 is installed. This ink jet apparatus is of a so-called real scanning type.

In the figure, ink jet head 208 is detachably mounted onto a carriage 206 which is guided by means of guide shafts 205. The ink jet head is scanned in a direction substantially perpendicularly intersecting the direction of transporting a record sheet 202. Numeral reference 201 stands for a transportation roller which serves to transport the record sheet 202 to a desired portion along a platen 203. Numeral reference 204 stands for a recovering means which serves to maintain the state of the discharging outlet as desired at a home position Hp. This recovering means includes a flexible cap capable of covering the discharging outlet, a vacuum pump capable of aspirating ink from the discharging outlet, and the like.

In this ink jet recording apparatus, drive of each of the recording sheet transportation means, head scanning means and discharge-recovering means, drive of the recording head, and the like are controlled based on a demand or signal outputted from a control means containing a CPU disposed on the apparatus body side.

Figure 16:
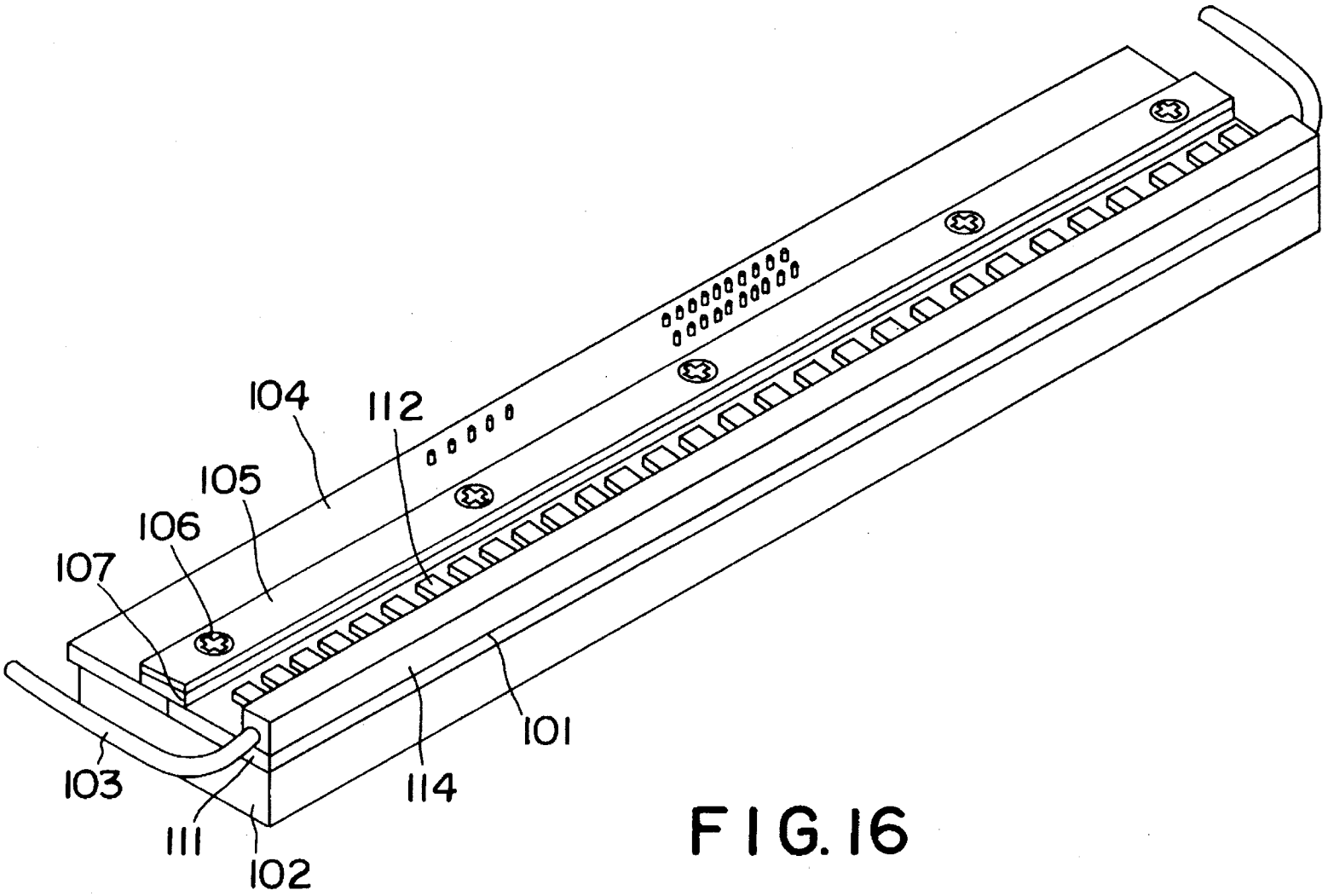
FIG. 16 is a schematic view illustrating a full-line type ink jet head provided with discharging outlets being arranged along the entire width of a record area of a recording member.

FIG. 16 is a schematic view illustrating an embodiment of a full-line type ink jet recording head provided with more than 1000 discharging outlets along the entire width of the recording area of a sheet on which an image is to be recorded. In the figure, a substrate 111 for ink jet head provided with a plurality of semiconductor devices 112, specifically, a plurality of driving ICs for example, is arranged together with a flexible cable 104 on a supporting member 102, and they are fastened through a pressure rubber member 107 comprising a thin plate-like flexible body by means of a flexible cable pressure member 105 having rigidity and four setscrews 106 such that the wiring portion of the substrate 111 and the flexible cable 104 are mechanically fixed while being electrically connected with each other. Numeral reference 103 stands for an ink supply pipe, comprising a flexible tube, for supplying ink into the common ink chamber of the head through its both sides.

The common ink chamber indicated by numerals reference 1108 and the ink pathways indicated by numeral reference 1110 respectively found in FIG. 14 are formed respectively as a concave portion at an ink pathway forming member 104. Likewise, the discharging outlets indicated by numeral reference 1111 which are found in FIG. 14 are arranged in series at the portion indicated by numeral reference 101 in the figure. And the ink jet head is realized by fixing these on the substrate 111.

Figure 17:
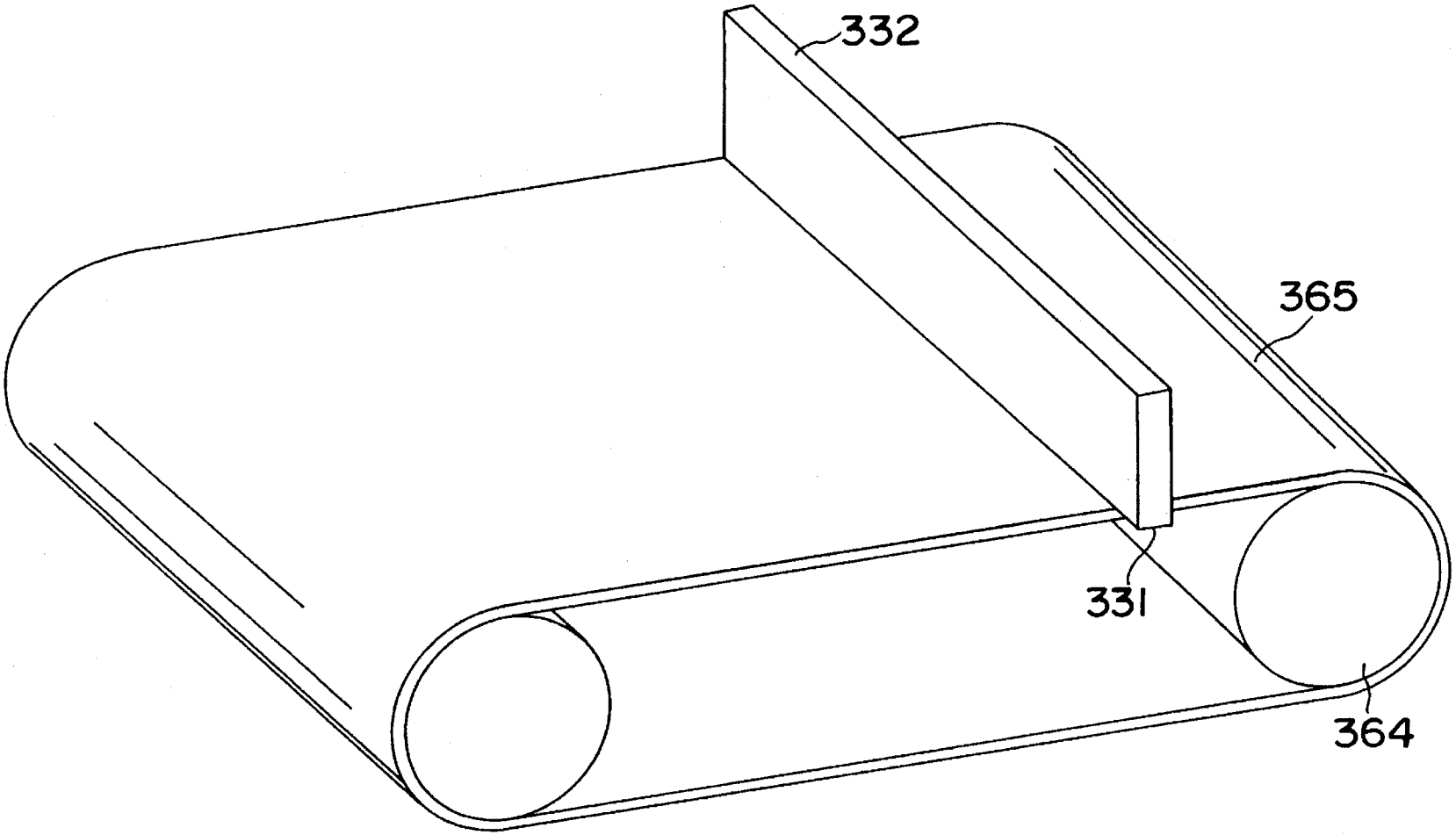
FIG. 17 is a schematic view illustrating an ink jet apparatus provided with a full-line type ink jet head.

FIG. 17 is a schematic slant view illustrating an outline of an ink jet recording apparatus in which the full-line type ink jet recording head is installed.

In the figure, numeral reference 365 stands for a transportation belt for transporting a member on which record is to be made such as paper. This transportation belt 365 serves to transport a member on which record is to be made (not shown in the figure) upon revolution of transportation rollers 364. The lower face of an ink jet recording head 332 is so designed as to form a discharging outlet face at which a plurality of discharging outlets are arranged so as to correspond to the recording area of a member on which record is to be made.

EXAMPLES

In the following, the present invention will be described more in detail in accordance with examples.

EXAMPLE 1

On a Si single crystal support member 41 having a $SiO_2$ film (film thickness: 2.75 um) on the surface thereof which was formed by thermal oxidation, there was formed a $HfB_2$ layer (layer thickness: 1000 Å) to be the heat generating resistor layer by sputtering $HfB_2$ (of more than 99.9% in purity) as the target in a vacuum chamber. The sputtering conditions in this case were made as follows:

Sputtering conditions the area of the target: 8 inch in diameter
high frequency power: 1500 W
set temperature of the base member: 100° C.
film formation period of time: 20 minutes
base pressure: less than $1\times10^{-5}$ Pa
sputtering gas: argon gas
sputtering gas pressure: 0.5 Pa Then, the above sputtering procedures were repeated, except that the target was replaced by a target comprising Ti (of more than 99.9% in purity) and the film formation period of time was changed to one minute, to perform sputtering process, whereby a Ti layer (layer thickness: 50 Å) was formed.

In this example, the stacked constitution comprising the $HfB_2$ layer and Ti layer being stacked becomes the first electrode contact layer 42.

Subsequently, the foregoing sputtering procedures were repeated, except that the target was replaced by a target comprising Al (of more than 99.9% in purity), the high frequency power was changed to 500 W and the film formation period of time was changed to six minutes, to perform sputtering process, whereby an Al layer (film thickness: 4500 Å) to be the first wiring electrode layer 43 was formed (as for these steps, see, FIG. 4(*a*) through FIG. 4(*b*)).

Successively, as for the stacked constitution comprising $HfB_2$ layer and Ti layer and the Al layer, patterning by photolithography was performed in the following manner. Firstly, photoresist (trademark name: OFPR 800, produced by Tokyo Ohka Company) was applied onto the Al layer to form a layer (layer thickness: 1.3 μm), which was followed by subjecting to conventional exposure, development and baking. The resultant was subjected to etching with the use of an etching solution comprising a mixed solution comprising acetic acid, phosphoric acid and nitric acid (9% by weight of acetic acid, 73% by weight of phosphoric acid, 2% by weight of nitric acid, and 16% by weight of the residual) to etch the Al layer. Thereafter, the resultant was subjected to reactive etching in a vacuum chamber to etch the stacked constitution comprising $HfB_2$ layer and Ti layer, and the photoresist was removed. Thus, patterning was completed (pattern width: 12 μm, the number of patterns: 4736).

The conditions for the above reactive etching were made as follows.

Reactive etching conditions high frequency power: 450 W
etching period of time: 5 minutes
base pressure: less than $1\times10^{-3}$ Pa
etching gas: $BCl_3$
etching gas pressure: 3 Pa (as these steps, see, FIG. 5(*a*) through FIG. (*b*)).

Then, sputtering was performed using Ti (of more than 99.9% in purity) as a target in a vacuum chamber under the foregoing sputtering conditions except for changing the film formation period of time to four minutes, to thereby form a Ti layer (layer thickness: 200 Å) to be the second electrode contact layer 44.

Further sputtering was performed using a target comprising Al (of more than 99.9% in purity) instead of the above target under the foregoing sputtering conditions except for changing the high frequency power to 5000 W and the film formation period of time to two minutes, to thereby form an Al layer (film thickness: 1500 Å) to be the second wiring electrode layer 45 (as for these steps, see, FIG. 6(*a*) through FIG. 6(*b*)).

Successively, as for the Ti layer and the Al layer, patterning by photolithography was performed in the following manner. Firstly, the same kind of photoresist as in the above was applied onto the Al layer to form a layer (layer thickness: 1.3 μm), which was followed by subjecting to conventional exposure, development and baking. The resultant was subjected to etching with the use of the same etching solution as in the above to etch the Al layer. Thereafter, the resultant was subjected to reactive etching in a vacuum chamber to etch the Ti layer under the foregoing reactive etching conditions except for changing the etching period of time to four minutes and the etching gas to $CF_4$, and the photoresist was removed. Thus, patterning was completed (pattern width: 8 μm, the number of patterns: 4736). (as for these steps, see, FIG. 7(*a*) through FIG. 7(*b*))

Then, as for the Al layer to be the first wiring electrode layer 43, patterning by photolithography was performed in the following manner. That is, the same kind of photoresist as in the above was applied onto the Al layer to form a layer (layer thickness: 1.3 μm), which was followed by subjecting to conventional exposure, development and baking, successively followed by etching with the use of the foregoing etching solution to thereby etch the Al layer. The photoresist was removed. Thus, there were formed 4736 heat generating portions each being 20 μm×100 μm in size (as for these steps, see, FIG. 8(*a*) through FIG. 8(*c*)).

On the thin films stacked structure thus formed on the base member was formed a $SiO_2$ layer (layer thickness: 1.3 μm) as the protective layer by means of sputtering. Thus, there was obtained a substrate for ink jet head according to the present invention.

On the substrate for ink jet head thus obtained were formed walls of ink pathways 1110 in communication to discharging outlets 1111 using a photosensitive resin. On the resultant was disposed a glass plate as the top plate 1106. As a result, there was obtained an ink jet head of the constitution schematically shown in FIG. 14.

This ink jet head had 4736 discharging outlets corresponding to the foregoing heat generating portions.

There were prepared 100 ink jet heads of the above constitution in total.

EXAMPLE 2

On a support member 21 of the same kind as in Example 1, there was formed a Ti layer (layer thickness: 50 Å) to be the first electrode contact layer 22 by sputtering Ti (of more than 99.9% in purity) as the target in a vacuum chamber. The sputtering conditions in this case were made as follows:

Sputtering conditions the area of the target: 8 inch in diameter high frequency power: 1500 W
set temperature of the base substrate member: 100° C.
film formation period of time: one minute
base pressure: less than $1\times10^{-5}$ Pa
sputtering gas: argon gas
sputtering gas pressure: 0.5 Pa.

Then, sputtering was performed using target comprising Al (of more than 99.9% in purity) instead of the above target under the above sputtering conditions except for changing the high frequency power to 5000 W and the film formation period of time to six minutes, to thereby form an Al layer (film thickness: 4500 Å) to be the first wiring electrode layer 23 (as for these steps, see, FIG. 9(*a*) through FIG. 9(*b*)).

Successively, as for the Ti layer and the Al layer, patterning by photolithography was performed in the following manner. Firstly, photoresist of the same kind as in Example 1 was applied onto the Al layer to form a layer (layer thickness: 1.3 μm), which was followed by subjecting to conventional exposure, development and baking. The resultant was subjected to etching with the use of an etching solution of the same kind as in Example 1 to etch the Al layer. After removing the photoresist therefrom, the resultant was subjected to sputter-etching in a vacuum chamber to pattern the Ti layer (pattern width: 8 μm, the number of patterns: 4736).

The conditions for the above sputter-etching were made as follows.

Sputtering-etching conditions
high frequency power: 500 W
etching period of time: 2 minutes
etching gas: argon
etching gas pressure: 0.5 Pa (as for these steps, see, FIG. 10(*a*) through FIG. 10(*c*)).

Then, sputtering was performed using $HfB_2$ (of more than 99.9% in purity) as a target in a vacuum chamber under the foregoing sputtering conditions except for changing the film formation period to time to twenty minutes, to thereby form a $HfB_2$ layer (layer thickness: 200 Å) to be the heat generating resistor layer.

Further sputtering was performed using a target comprising Ti (of more than 99.9% in purity) instead of the above target under the same sputtering conditions in the foregoing case of sputtering Ti, to thereby form a Ti layer (film thickness: 50 Å).

In this example, the stacked constitution of the $HfB_2$ layer and Ti layer was made to be the second electrode contact layer 24.

Then, sputtering was performed using a target comprising Al (of more than 99.9% in purity) instead of the above target under the foregoing sputtering conditions except for changing the high frequency power to 5000 W and the film formation period of time to two minutes, to thereby form an Al layer (film thickness: 1500 Å) to be the second wiring electrode layer 25 (as for these steps, see, FIG. 11(*a*) through FIG. 11(*c*)).

Successively, as for the stacked constitution of the $HfB_2$ layer and the Ti layer, and the Al layer, patterning by photolithography was performed in the following manner. Firstly, the same kind of photoresist as in the above was applied onto the Al layer to form a layer (layer thickness: 1.3 μm), which was followed by subjecting to conventional exposure, development and baking. The resultant was subjected to etching with the use of the same etching solution as in the above to etch the Al layer. Thereafter, the resultant was subjected to reactive etching in a vacuum chamber to etch the $HfB_2$ layer and the Ti layer under the following reactive etching conditions. The photoresist was then removed.

Reactive etching conditions
high frequency power: 450 W
etching period of time: 5 minutes
base pressure: less than $1\times10^{-3}$ Pa
etching gas: $BCl_3$
etching gas pressure: 3 Pa Thus, patterning was completed (pattern width: 12 μm, the number of patterns: 4736). (as for these steps, see, FIG. 12(*a*) through FIG. 12(*c*)).

Then, as for the Al layer to be the first wiring electrode layer 23, patterning by photolithography was performed in the following manner. That is, photoresist of the same kind as in the foregoing case was applied onto the Al layer to form a layer (layer thickness: 1.3 μm), which was followed by subjecting to conventional exposure, development and baking, successively followed by etching with the use of the foregoing etching solution to thereby etch the Al layer. The photoresist was removed. Thus, there were formed 4736 heat generating portions each being 20 μm×100 μm×100 μm in size (as for these steps, see, FIG. 13(*a*) through FIG. 13(*c*)).

On the thin films stacked structure thus formed on the base member was formed a $SiO_2$ layer (layer thickness: 1.3 μm) as the protective layer by means of sputtering. Thus, there was obtained a substrate for ink jet head according to the present invention.

On the substrate for ink jet head thus obtained were formed walls of ink pathways 1110 in communication to discharging ports 1111 using a photosensitive resin. On the resultant was disposed a glass plate as the top plate 1106. As a result, there was obtained an ink jet head of the constitution schematically shown in FIG. 14.

This ink jet head had 4736 discharging ports corresponding to the foregoing heat generating portions There were prepared 100 ink jet heads of the above constitution in total.

COMPARATIVE EXAMPLE 1

The procedures of Example 1 were repeated, except that neither the second electrode contact layer 44 nor the second wiring electrode layer 45 were formed and the layer thickness of the first wiring electrode layer 43 was made to be 6000 Å, to thereby obtain a substrate for ink jet head and an ink jet head provided with said substrate.

In this way, there were prepared 100 ink jet heads in total.

COMPARATIVE EXAMPLE 2

The procedures of Example 2 were repeated, except that neither the second electrode contact layer 24 nor the second wiring electrode layer 25 were formed and the layer thickness of the first wiring electrode layer 23 was made to be 6000 Å, to thereby obtain a substrate for ink jet head and an ink jet head provided with said substrate.

In this way, there were prepared 100 ink jet heads in total.

COMPARATIVE EXPERIMENTS

As for the 100 ink jet heads obtained in each of Examples 1 to 2 and Comparative Examples 1 to 2, observation was made about the situation of occurrence of discontinuation at the wiring electrode. As a result, it was found that the incidence of discontinuation in Example 1 or 2 is about half that in Comparative Example 1 or 2.

Further, as for the 100 ink jet heads obtained in each of Examples 1 to 2 and Comparative Examples 1 to 2, each of them was set to an identical apparatus body to discharge ink, whereby recording was performed. As a result, it was found that the quality of the record obtained by using any of the ink jet heads obtained in Examples 1 to 2 is markedly surpassing that obtained by using any of the ink jet heads obtained in Comparative Examples 1 to 2.

The present invention provides marked effects in a recording head and a recording apparatus of the system in which ink is discharged utilizing thermal energy.

As for representative constitution and the principle, it is desired to adopt such fundamental principal as disclosed, for example, in U.S. Pat. No. 4,723,129 or U.S. Pat. No. 4,740,796. While this system is capable of applying to either the so-called on-demand type or the continuous type, it is particularly effective in the case of the on-demand type because, by applying at least one driving signal for providing a rapid temperature rise exceeding nucleate boiling in response to recording information to an electrothermal converting body disposed for a sheet on which liquid (ink) is to be held or for a liquid pathway, the electrothermal converting body generates thermal energy to cause film boiling in ink on a heat acting face of the recording head and as a result, a gas bubble can be formed in the liquid (ink) in a one-by-one corresponding relationship to such driving signal. By way of growth and contraction of this gas bubble, the liquid (ink) is discharged through a discharging outlet to form at least one droplet. It is more desirable to make the driving signal to be of a pulse shape, since in this case, growth and contraction of a gas bubble take place instantly and because of this, there can be attained discharging of the liquid (ink) excelling particularly in responsibility. As the driving signal of pulse shape, such driving signal as disclosed in U.S. Pat. No. 4,463,359 or U.S. Pat. No. 4,345,262 is suitable. Additionally, in the case where those conditions disclosed in U.S. Pat. No. 4,313,124, which relates to the invention concerning the rate of temperature rise at the heat acting face, are adopted, further improved recording can be performed.

As for the constitution of the recording head, the present invention includes, other than those constitutions of the discharging outlets, liquid pathways and electrothermal converting bodies in combination (linear liquid flow pathway or perpendicular liquid flow pathway) which are disclosed in each of the above patent specifications, the constitutions using such constitution in which a heat acting portion is disposed in a curved region which is disclosed in U.S. Pat. No. 4,558,333 or U.S. Pat. No. 4,459,600. In addition, the present invention may effectively take a constitution based on the constitution in which a slit common to a plurality of electrothermal converting bodies is used as a discharging portion of the electrothermal converting bodies which is disclosed in Japanese Unexamined Patent Publication No. 123670/1984 or other constitutions based on the constitution in which an opening for absorbing a pressure wave of thermal energy is made to be corresponding to a discharging portion which is disclosed in Japanese Unexamined Patent Publication No. 138461/1984.

Further, as the full-line type recording head having a length corresponding to the width of a maximum record medium which can be recorded by a recording apparatus, there can be employed either such constitution that the length is completed by such a combination of a plurality of recording heads as disclosed in the foregoing specifications or other constitution comprising a single recording head formed as an integrated structure, and in either case, the present invention provides the foregoing effects further effectively.

The present invention is effective also in the case where a recording head of the exchangeable chip type wherein electric connection to an apparatus body or supply of ink from the apparatus body is enabled when it is mounted on the apparatus body or other recording head of the cartridge type wherein an ink tank is integrally provided on the recording head itself is employed.

Further, it is desirable to add restoring means to a recording head or preparatory auxiliary means or the like as a constituent of the constitution of the recording apparatus according to the present invention in view of stabilizing the effects of the present invention. Specifically in this respect, capping means, cleaning means, pressurizing or attracting means, preliminary heating means including an electrothermal converting body or a separate heating element or a combination of these for the recording head, and to employ a preparatory discharging mode in which discharging is performed separately from recording, are also effective in order to achieve stable recording.

Furthermore, the present invention is extremely effective not only in a recording apparatus which has, as the recording mode, a recording mode of a main color such as black but also in an apparatus which includes a plurality of different colors or at least one of full-colors by color mixture, in which a recording head is integrally constituted or a plurality of recording heads are combined.

In the above-mentioned examples of the present invention, explanation was made with the use of liquid ink, but it is possible to use such ink that is in a solid state at room temperature or other ink that becomes to be in a softened state at room temperature in the present invention. In the foregoing ink jet apparatus, it us usual to adjust the temperature of ink itself in the range of 30° C. to 70° C. such that the viscosity of ink lies in the range capable of being stably discharged. In view of this, any ink can be used as long as it is in a liquid state upon the application of a use record signal. In addition, in the present invention, it is also possible to use those inks having a property of being liquefied, for the first time, with thermal energy, such as ink that can be liquefied and discharged in liquid state upon application of thermal energy depending upon a record signal or other ink that can start is solidification beforehand at the time of its arrival at a recording medium in order to prevent the temperature of the head from raising due to thermal energy by purposely using thermal energy as the energy for a state change of ink from solid state to liquid state or in order to prevent ink from being vaporized by solidifying the ink in a state of being allowed to stand. In the case of using these inks, it can be used in such manner as disclosed in Japanese Unexamined Patent Publication No. 56847/1979 or Japanese Unexamined Patent Publication No. 71260/1985 that such ink is maintained in concaved portions or penetrations of a porous sheet in a liquid state or in a solid state and the porous sheet is arranged to be such a configuration opposite to the electrothermal converting body. In the present invention, the most effective discharging system for each of the above-mentioned inks is the foregoing film-boiling system.

I claim:

1. A substrate for an ink jet head, said substrate comprising:

a pair of first wiring electrode layers having a first pattern and being disposed on a base member through a first electrode contact layer; and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers covers said pair of first wiring electrode layers through said second electrode contact layer, wherein said first electrode contact layer contains a heat generating resistor layer for generating heat upon application of a voltage through said pair of first wiring electrode layers and said pair of second wiring electrode layers.

2. A substrate for an ink jet head according to claim 1, wherein the second electrode contact layer has an etching selectivity against the second wiring electrode layers.

3. A substrate for an ink jet head according to claim 1, wherein the first electrode contact layer has a stacked structure containing the heat generating resistor layer.

4. A substrate for an ink jet head according to claim 1, including a stacked structure comprising the first wiring electrode layers, the second electrode contact layer, the second wiring electrode layers, said stacked structure is comprised of a multilayered structure comprising Al layer, Ti layer, Al layer; Al layer, Cr layer, Al layer; Cu layer, Ti layer, Cu layer; Au layer, Ni layer, Au layer; or Al layer, TaSi layer, Cu layer.

5. An ink jet head comprising:

a substrate comprising a pair of first wiring electrode layers having a first pattern being disposed on a base member through a first electrode contact layer and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers covers said pair of first wiring electrode layers through said second electrode contact layer, wherein said first electrode contact layer contains a heat generating resistor layer for generating heat upon application of a voltage through said pair of first wiring electrode layers and said pair of second wiring electrode layers;

a discharging outlet for discharging ink; and an ink pathway in communication with said discharging outlet for discharging ink, said ink pathway being disposed to correspond to a heat generating portion of said heat generating resistor layer positioned between said pair of first wiring electrode layers and between said pair of second wiring electrode layers on said base member, wherein ink is discharged through said discharging outlet utilizing thermal energy that said heat generating portion generates.

6. An ink jet head according to claim 5, wherein the ink jet head is of a full-line type that has a plurality of discharging outlets along an entire width of a recording region of a recording member.

7. An ink jet apparatus comprising:

an ink jet head having a substrate comprising a pair of first wiring electrode layers having a first pattern being disposed on a base member through a first electrode contact layer and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers covers said pair of first wiring electrode layers through said second electrode contact layer, wherein said first electrode contact layer contains a heat generating resistor layer for generating heat upon application of a voltage through said pair of first wiring electrode layers and said pair of second wiring electrode layers, a discharging outlet for discharging ink, and an ink pathway in communication with said discharging outlet for discharging ink, said ink pathway being disposed to correspond to a heat generating portion of said heat generating resistor layer positioned between said pair of first wiring electrode layers and between said pair of second wiring electrode layers on said base member, wherein ink is discharged through said discharging outlet utilizing thermal energy that said heat generating portion generates; and transportation means for transporting a recording member which is recorded upon by said ink jet head.

8. An ink jet apparatus according to claim 7, wherein the ink jet head is of a full-line type that has a plurality of discharging outlets along an entire width of a recording region of the recording member.

9. A substrate for an ink jet head, said substrate comprising:

a pair of first wiring electrode layers having a first pattern being disposed on a base member through a first electrode contact layer; and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers covers said pair of first wiring electrode layers through said second electrode contact layer, wherein said second electrode contact layer contains a heat generating resistor layer for generating heat upon application of a voltage through said pair of first wiring electrode layers and said pair of second wiring electrode layers.

10. A substrate for an ink jet head according to claim 9, wherein the second electrode contact layer has an etching selectivity against the second wiring electrode layers.

11. A substrate for an ink jet head according to claim 9, wherein the second electrode contact layer has a stacked structure containing the heat generating resistor layer.

12. A substrate for an ink jet head according to claim 9, wherein a stacked structure comprises the first wiring electrode layers, the second electrode contact layer, the second wiring electrode layers, said stacked structure including Al layer, Ti layer+a resistant material layer, Al layer; Al layer, Cr layer+a resistant material layer, Al layer; Cu layer, Tr layer+a resistant material layer, Cu layer; Au layer, Ni layer+a resistant material layer, Au layer; or Al layer, TaSi layer, Cu layer.

13. An ink jet head comprising:

a substrate comprising a pair of first wiring electrode layers having a first pattern being disposed on a base member through a first electrode contact layer and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers cover said pair of first wiring electrode layers through said second electrode contact layer, wherein said second electrode contact layer contains a heat generating resistor layer for generating heat upon application of a voltage through said pair of first wiring electrode layers and said pair of second wiring electrode layers;

a discharging outlet for discharging ink; and an ink pathway in communication with said discharging outlet for discharging ink being disposed to correspond to a heat generating portion of said heat generating resistor layer positioned between said pair of first wiring electrode layers and between said pair of second wiring electrode layers on said base member, wherein ink is discharged through said discharging outlet utilizing thermal energy that said heat generating portion generates.

14. An ink jet head according to claim 13, wherein the ink jet head is of a full-line type that has a plurality of discharging outlets along an entire width of a recording region of a recording member.

15. An ink jet apparatus comprising:

an ink jet head having a substrate comprising a pair of first wiring electrode layers having a first pattern being disposed on a base member through a first electrode contact layer and a pair of second wiring electrode layers having a second pattern which is similar to that of said first pattern, said pair of second wiring electrode layers being disposed on said pair of first wiring electrode layers through a second electrode contact layer comprised of an electroconductive material so that said pair of second wiring electrode layers covers said pair of first wiring electrode layers through said second electrode contact layer, wherein said second electrode contact layer contains a heat generating resistor layer for generating heat upon application of a voltage through said pair of first wiring electrode layers and said pair of second wiring electrode layers, a discharging outlet for discharging ink, and an ink pathway in communication with said discharging outlet for discharging ink being disposed to correspond to a heat generating portion of said heat generating resistor layer positioned between said pair of first wiring electrode layers and between said pair of second wiring electrode layers on said base member, wherein ink is discharged through said discharging outlet utilizing thermal energy that said heat generating portion generates; and transportation means for transporting a recording member which is recorded upon by said ink jet head.

16. An ink jet apparatus according to claim 15, wherein the ink jet head is of a full-line type that has a plurality of discharging outlets along an entire width of a recording region of said recording member.

17. A process for producing a substrate for an ink jet head, said process comprising the steps of:

forming a first material layer for a first electrode contact layer and a second material layer for a first wiring electrode layer in sequence on a base member;

patterning said second material layer to form said first wiring electrode layer having a first pattern;

patterning said first material layer to form said first electrode contact layer;

forming, on said first electrode contact layer, a third material layer for a second wiring electrode layer and a fourth material layer for a second electrode contact layer, said fourth material layer having an etching selectivity against said third material layer, such that said fourth material layer is positioned next to said first wiring electrode layer;

subjecting said third material layer to patterning by way of etching to form said second wiring electrode layer having a second pattern which is similar to that of said first pattern, such that said second wiring electrode layer covers said first wiring electrode layer; and patterning said fourth material layer to form said second electrode contact layer.

18. The process for producing a substrate for an ink jet head according to claim 17, wherein a discontinued portion is formed for the first wiring electrode layer, the second electrode contact layer and the second wiring electrode layer, and the first electrode contact layer positioned at said discontinued portion functions as a heat generating portion.

19. The process for producing a substrate for an ink jet head according to claim 17, wherein a discontinued portion is formed for the first electrode contact layer, the first wiring electrode layer and the second wiring electrode layer, and the second electrode contact layer positioned at said discontinued portion functions as a heat generating portion.

* * * * *

UNITED STATES PATENT AND TRADEMARK OFFICE

CERTIFICATE OF CORRECTION

PATENT NO. : 5,483,270

DATED : January 9, 1996

INVENTOR(S) : YASUTOMO WATANABE

It is certified that error appears in the above-indentified patent and that said Letters Patent is hereby corrected as shown below:

COLUMN 1

Line 37, "line D-D'" should read --line 3(b)-3(b)--.
Line 43, "line D-D'" should read --line 2(b)-2(b)--.

COLUMN 2

Line 8, "being" should read --is--.
Line 32, "tile" should read --the--.
Line 42, "subject. In" should read --subject in--.

COLUMN 3

Line 32, "have" should read --has--.

COLUMN 4

Line 14, "above mentioned" should read --above-mentioned--.
Line 30, "line D-D'" should read --line 2(b)-2(b)--.
Line 35, "line D-D'" should read --line 3(b)-3(b)--.
Line 49, "line B-B'" should read --line 5(b)-5(b)--.
Line 51, "line A-A'" should read ---line 5(c)-5(c)--.
Line 65, "FIG. 7(c)" should read --¶ FIG. 7(c)--.

COLUMN 5

Line 22, "line B-B'" should read --line 10(b)-10(b)--.
Line 24, "line A-A'" should read --line 10(c)-10(c)--.

UNITED STATES PATENT AND TRADEMARK OFFICE

CERTIFICATE OF CORRECTION

PATENT NO. : 5,483,270

DATED : January 9, 1996

INVENTOR(S) : YASUTOMO WATANABE

It is certified that error appears in the above-identified patent and that said Letters Patent is hereby corrected as shown below:

COLUMN 6

Line 4, "line B-B'" should read --line 5(b)-5(b)--.
Line 5, "line A-A'" should read --line 5(c)-5(c)--.
Line 7, "indication A-A'" should read --indication (c)-(c)-- and "indication B-B'" should read --indication (b)-(b)--.

COLUMN 7

Line 36, "line B-B'" should read --line 10(b)-10(b)--.
Line 38, "A-A'" should read --10(c)-10(c)--.
Line 40, "A-A'" should read --(c)-(c) and "B-B'" should read --(b)-(b)--.

COLUMN 8

Line 15, "Layer 24" should read --layer 24--.

COLUMN 9

Line 28, "fist" should read --first--.

COLUMN 11

Line 20, "8 inch" should read --8 inches--.

UNITED STATES PATENT AND TRADEMARK OFFICE

CERTIFICATE OF CORRECTION

PATENT NO. : 5,483,270

DATED : January 9, 1996

INVENTOR(S) : YASUTOMO WATANABE

It is certified that error appears in the above-identified patent and that said Letters Patent is hereby corrected as shown below:

COLUMN 12

Line 67, "8 inch" should read --8 inches--.

COLUMN 13

Line 36, "to time" should read --of time--.

COLUMN 16

Line 34, "us" should read --is--.
Line 44, "is" should read --its--.
Line 46, "raising" should read --rising--.

COLUMN 17

Line 23, "multilayered" should read --multi-layered--.

UNITED STATES PATENT AND TRADEMARK OFFICE

CERTIFICATE OF CORRECTION

PATENT NO. : 5,483,270

DATED : January 9, 1996

INVENTOR(S) : YASUTOMO WATANABE

It is certified that error appears in the above-identified patent and that said Letters Patent is hereby corrected as shown below:

COLUMN 19

Line 1, "cover" should read --covers--.

Signed and Sealed this

Eleventh Day of March, 1997

*Attest:*

*Attesting Officer*

BRUCE LEHMAN

*Commissioner of Patents and Trademarks*